US006932088B1

(12) United States Patent
Berghash

(10) Patent No.: US 6,932,088 B1
(45) Date of Patent: Aug. 23, 2005

(54) SUCTION-FITTED MOUTHGUARD

(75) Inventor: David Berghash, Williamsville, NY (US)

(73) Assignee: Shield Mfg. Inc., Tonawanda, NY (US)

( * ) Notice: Subject to any disclaimer, the term of this patent is extended or adjusted under 35 U.S.C. 154(b) by 0 days.

(21) Appl. No.: 10/839,102

(22) Filed: May 5, 2004

(51) Int. Cl.[7] ..... A61C 5/14
(52) U.S. Cl. ..... 128/861; 128/859; 128/862
(58) Field of Search ..... 128/859, 860, 128/861, 862, 846, 848; 433/6; 602/902

(56) References Cited

U.S. PATENT DOCUMENTS 4,059,101 A * 11/1977 Richmond ..... 601/139
4,164,940 A * 8/1979 Quinby ..... 601/164
4,350,154 A * 9/1982 Feldbau ..... 128/861
5,955,393 A * 9/1999 Moskovitz et al. ..... 502/5
6,830,051 B1 * 12/2004 Lesniak et al. ..... 128/859

* cited by examiner

*Primary Examiner*—Henry Bennett
*Assistant Examiner*—Camtu Nguyen
(74) *Attorney, Agent, or Firm*—Phillips Lytle LLP

(57) ABSTRACT

A mouthguard (10) has a U-shaped base (11) having an upper surface (16) and a lower surface (18). An inner wall (19) extends upwardly from an inner margin of the base upper surface. An outer wall (21) extends upwardly from an outer margin of the base upper surface. The inner and outer walls defined with the base upper surface a trough adapted to receive a person's upper teeth. The improvement comprises a recess (24) that extends into at least one of the inner wall and base proximate the wearer's front or incisor teeth, and extends between the base upper and lower surfaces. The recess is so positioned, configured and arranged as to enable the wearer to suck fluids from the trough through the recess when the mouthguard is installed such that the mouthguard will fit more closely then if such fluids were present in the trough.

3 Claims, 1 Drawing Sheet

SUCTION-FITTED MOUTHGUARD

TECHNICAL FIELD

The present invention relates generally to the field of mouthguards, and, more particularly, to an improved closely-fitting mouthguard, the installation of which is aided by suction.

BACKGROUND ART

Dental mouthguards have been developed. These are traditionally worn by people who are engaged in physically exertive activity and sports, such as such as football and the like.

Most dental mouthguards comprise a U-shaped base having inner and outer flanges that extend upwardly therefrom. The mouthguard generally embraces the wearer' s upper teeth, and functions to cushion the impact of the upper and lower teeth in response to jarring action or impact.

Examples of such prior art dental mouthguards are shown and described in U.S. Pats. No. 4,337,765, 5,152,301, 5,234,005, 6,675,806, 6,691,710, 6,584,978, 6,082,363 and 4,848,765.

U.S. Pat. No. 4,063,552 is of particular interest for its disclosure of a closely-fitting mouthguard that is placed in hot water to initially soften a thermoplastic material. Thereafter, the user bites down on the softened plastic to impress the pattern of his upper teeth therein. The mouthguard is then permitted to cool and harden. This patent also discloses that a secondary level of adhesion is obtained by the wearer biting on the mouthguard to firmly seat it, and thereafter sucking air from between the guard and the tissues "as one would suck on a small piece of hard candy or a cough drop". (See, '552 patent, col. 9, line 40 et seq.).

It would be generally desirable to provide an improvement to such a suction-fitted mouthguard.

DISCLOSURE OF THE INVENTION

With parenthetical reference to the corresponding parts, portions or surfaces of the disclosed embodiment, merely for purposes of illustration and not by way of limitation, the present invention broadly provides an improved closely-fitting suction-assisted mouthguard (10).

The improved mouthguard broadly includes a U-shaped base (11) having an upper surface (16) and a lower surface (18), an inner wall (19) extending upwardly from an inner margin of the upper surface, and having an inner surface adapted to face toward the inside surface of a wearer's teeth, an outer wall (21) extending upwardly from an outer margin of the base upper surface and having an outside surface adapted to face toward the outside surface of the wearer's teeth, the inner and outer walls defining with the base upper surface a trough adapted to receive the wearer's upper teeth. The improvement broadly comprises a recess (24) extending into at least one of the inner wall and base upper surface proximate the wearer's front or incisor teeth, and extending between the base upper and lower surfaces. This recess is so positioned, configured and arranged as to enable the wearer to readily suck fluids (i.e., liquids and air) from the trough when the mouthguard is installed such that the mouthguard will fit more closely than if fluids were present in the trough.

When the mouthguard is initially installed, the wearer's bite will first direct some fluids from the trough through the recess. After this has occurred, the user may readily suck additional fluids through the recess. Hence, a subatmospheric pressure in the trough will cause the mouthguard to fit closely against the wearer's upper teeth.

The general object of this invention is to provide an improved mouthguard.

Another object is to provide an improved mouthguard that is capable of fitting the wearer's teeth very closely.

Still another object is to provide a suction-fitted mouthguard that is comfortable to wear.

These and other objects and advantages will become apparent from the foregoing and ongoing written specification, the drawings, and the appended claims.

DESCRIPTION OF THE PREFERRED EMBODIMENTS

Figure 3:
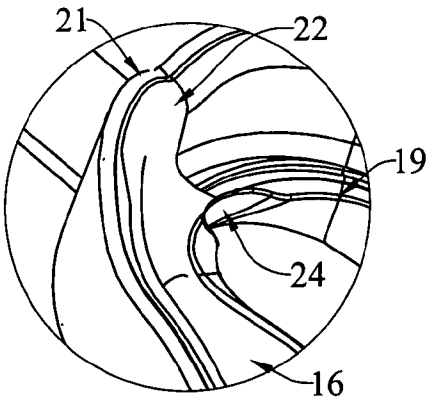
FIG. 3 is an enlarged perspective view, of the area encompassed within the indicated circle of FIG. 1, and showing the recess.
Figure 4:
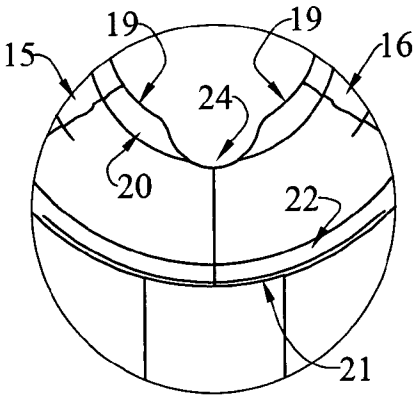
FIG. 4 is an enlarged view of the structure shown within the indicated area of FIG. 2, this view also showing the frontal portion of the mouthguard with the improved recess.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

Figure 1:
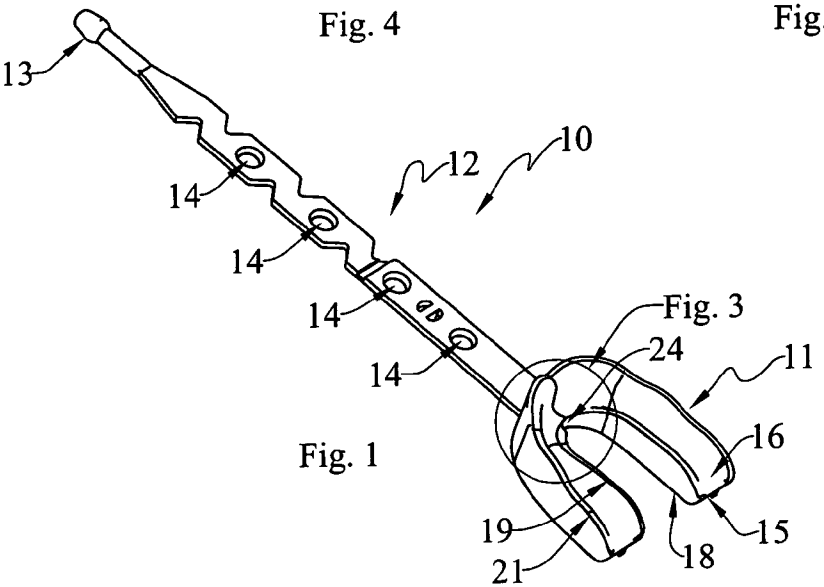
FIG. 1 is a perspective view of the improved mouthguard with an attached tethering strap.
Figure 2:
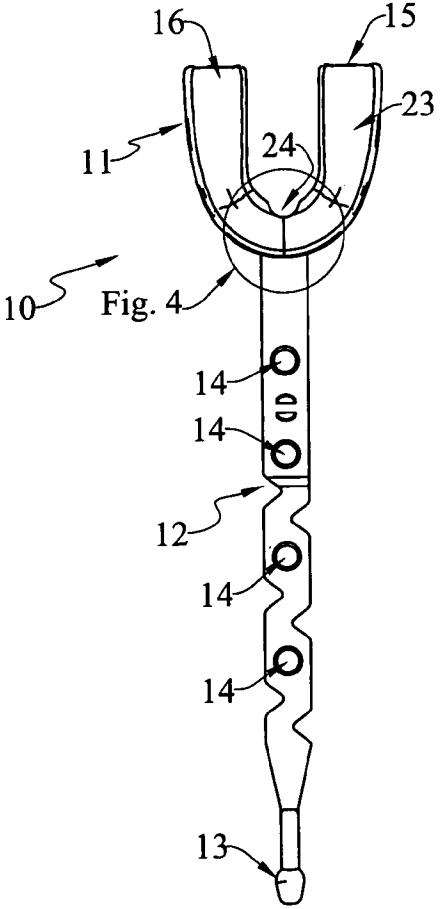
FIG. 2 is a top plan view of the mouthguard shown in FIG. 1.

Referring now to the drawings, and, more particularly, to FIG. 1, an improved mouthguard is generally indicated at 10. The improved mouthguard is shown as having a mouthguard portion 11 which is adapted to be placed in a wearer's mouth, and with a tethering strap, generally indicated at 12. This tethering strap has a distal end 13 that is adapted to encircle an object, such as a protective cage on a football helmet, and to be placed through any of a number of holes, severally indicated at 14, provided at axially-spaced locations along the strap. This strap 12, while desirable, is ancillary to the present invention.

Directed to the reader's attention more particularly to mouthguard portion 11, this is shown as indicating a generally U-shaped base 15 having an upper surface 16 and a lower surface 18. The mouthguard portion is also shown as having an inner wall, generally indicated at 19, extending upwardly from an inner margin of the base upper surface, and having an inner surface 20 adapted to face toward the inside surface of the wearer's teeth. The mouthguard also has an outer wall 21 extending upwardly from an outer margin of the base upper surface and having an outside surface 22 adapted to face toward the outside surface of the wearer's teeth. The inner and outer walls 19, 21, and the base upper surface 16, define a trough, generally indicated at 23, that is adapted to receive the wearer's upper teeth.

So much of a mouthguard as has been described as common to other mouthguards in the prior art. In the improved form, however, the mouthguard is provided with a recess, indicated at 24, that extends into at least one of the inner wall and base upper surface proximate the wearer's incisor teeth, and extends between the base upper and lower surfaces. Recess 24 is so positioned, configured and arranged as to enable the wearer to readily suck fluids from the trough when the mouthguard is installed. Thus, when the user initially installs the mouthguard, his initial bite will express fluids, such as saliva and air, through the recess. Thereafter, the wearer may readily suck additional fluids through the recess. This will create a subatmospheric pressure within the trough, and the atmospheric pressure will therefore cause the mouthguard to fit more closely against the wearer's upper teeth.

Therefore, the present invention provides a suction-fitted mouthguard.

Modifications

The present invention contemplates that many changes and modifications may be made. For example, the particular materials of construction are not deemed to be critical. The improved mouthguard may, for example, be formed of a thermal plastic material such that it may be initially heated, as by placement in boiling water, and then initially generally form fitted to the user's mouth.

The presence, or absence of a tethering strap is also immaterial. The recess should communicate the upper and lower surfaces of the base. It may extend into the inner wall and/or the base itself, as desired.

Therefore, while the presently preferred form of the improved suction-fitted mouthguard has been shown and described, and several modifications thereof discussed, persons skilled in this art will readily appreciate that various additional changes and modifications may be made without departing from the spirit of the invention, as defined and differentiated by the following claims.

What is claimed is:

1. A mouthguard including a U-shaped base having an upper surface and a lower surface, an inner wall extending upwardly from an inner margin of said base upper surface and having a inner surface adapted to face toward the inside surface of a wearer's teeth, a fluid-impervious outer wall extending upwardly from an outer margin of said base upper surface and having a outside surface adapted to face toward the outside surface of said wearer's teeth, said inner and outer walls defining with said base upper surface a trough adapted to receive said wearers upper teeth, wherein the improvement comprises:

a recess extending into at least one of said inner wall and said base proximate said wearer's incisor teeth and extending between said base upper and lower surfaces, said recess being so positioned, configured and arranged as to enable said wearer to suck fluids from said trough through said recess when said mouthguard is installed such that said mouthguard will fit more closely securely than if such removed fluids were present in said trough.

2. A mouthguard as set forth in claim 1 wherein said mouthguard wherein a subatmospheric pressure in said trough after said wearer has sucked fluids therefrom will cause said mouthguard to fit closely against said wearer's upper teeth.

3. A mouthguard as set forth in claim 1 wherein when said mouthguard is initially installed, the wearer's bite will direct fluids to flow from said trough through said recess.

* * * * *